United States Patent [19]

Enix

[11] Patent Number: 4,869,485

[45] Date of Patent: Sep. 26, 1989

[54] ENVELOPE HOLDER

[75] Inventor: Bruce W. Enix, Huber Heights, Ohio

[73] Assignee: Eastman Kodak Company, Rochester, N.Y.

[21] Appl. No.: 210,543

[22] Filed: Jun. 23, 1988

[51] Int. Cl.[4] ..... B65H 5/02

[52] U.S. Cl. ..... 271/2; 271/277; 271/205; 400/622; 400/635

[58] Field of Search ..... 271/204, 205, 206, 277, 271/2; 400/622, 635

[56] References Cited

U.S. PATENT DOCUMENTS 4,591,146 5/1986 Sasso ..... 271/204 X
4,636,099 1/1987 Goldstone ..... 400/622 X

FOREIGN PATENT DOCUMENTS 2973 5/1987 World Int. Prop. O. ..... 400/635

*Primary Examiner*—Richard A. Schacher
*Attorney, Agent, or Firm*—Dana M. Schmidt

[57] ABSTRACT

An envelope holder is described for feeding envelopes through a printer. It comprises a pocket formed from an upper and lower sheet joined together, a window portion of which is removed to allow printing of an envelope held in the pocket. The holder is improved in that the upper sheet has longitudinal edges that extend only a fraction of the length of the lower sheet portion that forms the pocket. That fraction is between about 30% and about 85% of the lower sheet length.

5 Claims, 3 Drawing Sheets

ENVELOPE HOLDER

FIELD OF THE INVENTION

This invention relates to holders used to carry envelopes through printers for proper printing of the envelopes.

BACKGROUND OF THE INVENTION

Envelopes are often one of the most diffcult media to have printed on automatic printers such as ink jet printers. The reason is that they are usually irregular in shape, and in any event have multiple-plys non-uniformly distributed. Thus, if the envelopes are not properly held, they tend to become skewed in the printer.

The early approaches to this problem have been to print addresses on peel-off labels, which can be run through printers on standard printer sheets. However, such labels require separate peel-and-stick steps. These render the appearance of being bulk mail, and hence unimportant mail to be discarded. Therefore, there has been a substantial need to provide a way for printing directly onto envelopes that are somehow held in a printer.

Holders have been provided for holding individual sheets on a sprocket-fed support that feeds through a printer. Such holders have a pocket that holds a portion that is not to be printed, the pocket being formed by an upper sheet sealed around three edges to a lower sheet. Examples are shown in, e.g. U.S. Pat. No. 4,591,146. In holders of that type, theupper sheet longitudinal edges are less than 15% of the potential depth of the pocket as measured by the longitudinally extending edges of the lower support of the holder, under the media. In other words, very little side edge engagement of the media is provided by the holder. Thus, such pockets are not suitable for holding envelopes, or other materials of non-uniform thickness. For one thing, they do not account for the fact that the non-uniformity of the envelope will cause it to skew as it passes through the printer, unless the envelope is properly held at the side edges that parallel the sprocket-hole edges. As will be shown hereinafter, attempts to prevent skewing by supporting hereinafter, attempts to prevent skewing by supporting the entire side edges of the envelope that parallel the sprocket edges of the support, tend to result in unacceptable binding or jamming of holder plus envelope, in the printer mechanism.

SUMMARY OF THE INVENTION

I have developed an envelope holder construction that balances the competing inconsistent demands that the envelope side edges be held to prevent skewing, and that there not be so much material passing through the printer as to cause the holder and envelope to jam in the printer.

More specifically, there is provided an envelope holder for holding and positioning an envelope for printing on a printer, the holder comprising a pocket defined by an upper sheet and a lower sheet joined to the upper sheet at selected places, the sheets having respective longitudinal edges, the upper sheet having a portion cut away to expose a portion of an envelope held in the holder, the selected joining places including at least longitudinal portions of the lower sheet adjacent to the longitudinal edges of the lower sheet, and at least a transverse portion adjacent to an edge of the lower sheet extending transversely between the lower sheet longitudinal edges, at least one of the upper sheet longitudinal edges extending only a fraction of the length of the lowe sheet from the transverse joined portion. The holder is improved in that the fraction is sufficiently large as to provide side support of envelopes that prevents skewing of an envelope that is passed through the printer in the holder, and sufficiently small as to prevent a held envelope and the holder from jamming in the printer.

Thus, it is an advantageous feature of the invention that an envelope holder is provided that can carry an envelope through conventional ink jet printers without the envelopes becoming skewed.

It is another advantageous feature of the invention that such envelopes can be printed on directly, giving the appearnce of being an individually prepared envelope rather than bulk mailing.

Other advantageous features will become apparent upon reference to the following Detailed Description of the Preferred Embodiments, when read in light of the attached drawings.

DESCRIPTION OF THE PREFERRED EMBODIMENTS

The invention is described particularly by reference to a preferred embodiment wherein a rectangular envelope is held for printing in an ink jet printer using a drum-shaped platen. In addition, the invention is applicable to the holding and carrying of non-rectangular envelopes through any conventional printer, wherein narrow spacing of printer parts can cause jamming if the print media is too thick, regardless of whether the platen is a drum type.

Figure 1:
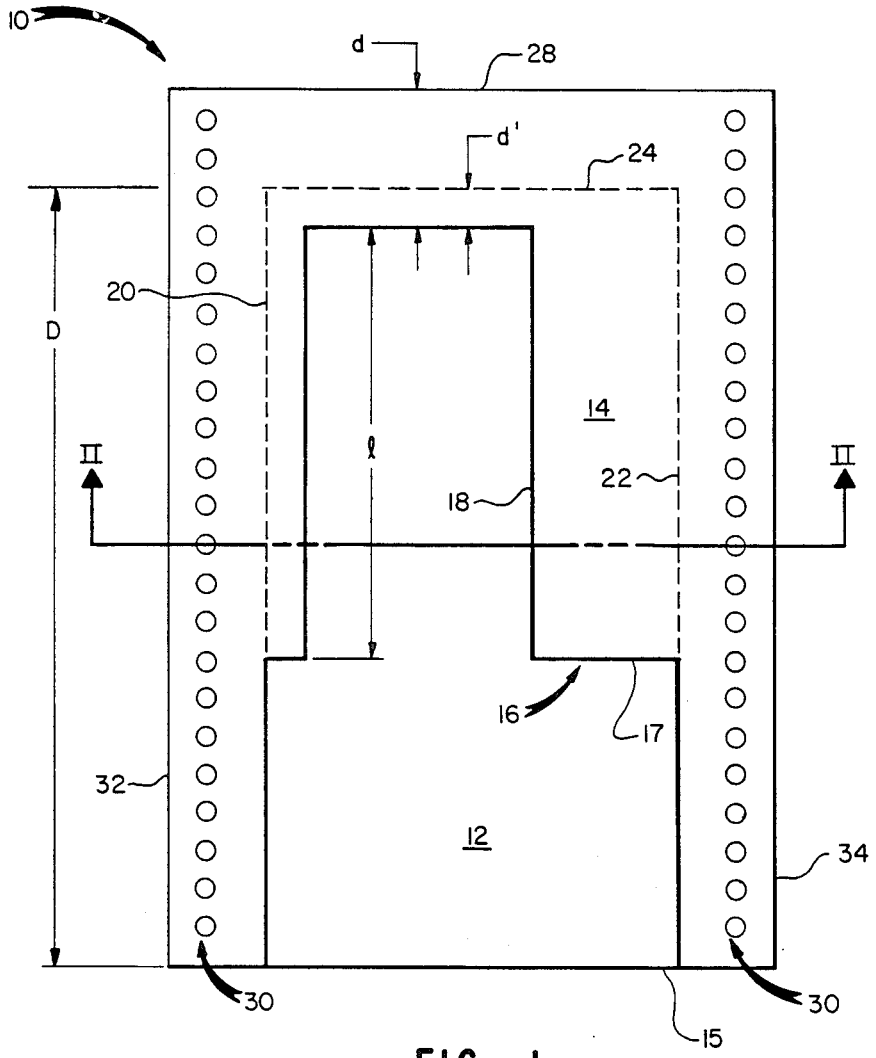
FIG. 1 is a plan view of an envelope holder prepared in accordance with the invention.
Figure 2:
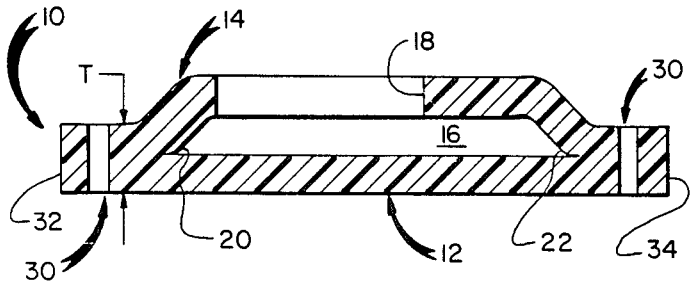
FIG. 2 is a fragmentary section view taken along the line II—II of FIG. 1, thicknesses having been exaggerated for clarity.

As shown in FIGS. 1 and 2, envelope holder 10 of the invention comprises a lower support sheet 12 and an upper cover sheet 14 joined to support sheet 12 to form a pocket 16. Sheets 12 and 14 have leading transverse edges 15 and 17, respectively, FIG. 1. Pocket 16 is cut away to provide a printing window 18, that is, a portion where upper sheet 14 is not in position to interfere with printing. Most preferably, window 18 is off-center to reflect the fact that the printing occurs on the envelope pocket (the multiple-ply portion) and not on the sealing flap.

Sheet 14 is joined to lower sheet 12 along at least portions of the longitudinal edges 20,22 of upper sheet 14, and a trailing transverse edge 24. Most preferably, the junction is continuous along those edges, as can be done by conventional glueing, heat-sealing, and like. Transverse edge 24 is adjacent to transverse edge 28 of sheet 12, FIG. 1.

Lower sheet 12 preferably has a line of perforations 30 extending along parallel to longitudinal edges 32 and 34 of the lower sheet. These perforations engage sprocket wheels on the printer for sprocket feed of the holder. Lower sheet 12 has a length D, FIG. 1, measured parallel to edges 32 and 34 and from edge 24. That is, if leading transverse edge 17 of sheet 14 were coincident with such edge 15 of lower sheet 12, then the depth of the pocket would be 100% of the length of lower sheet 12. The depth of pocket 16 is depth "1", having dimensions as determined by factors hereinafter described.

In accordance with the invention, depth 1 as provided at edges 20 and 22 extends only a particular fraction of the length D, FIG. 1, of sheet 12. More specifically, the edges of 20 and 22 are selected to provide a depth 1, which has been tested and found to be between about 30% and about 85% of the length of "D", in order to provide an opeative holder. If "1" is less than about 30% of "D", then there is insufficient edge support at edges 20 and 22 for preventing skewing of the envelopes. If "1" is greater than about 85% of "D", then there is too much material for the pocket, with an envelope in place, to pass through the printer without jamming or binding. Any suitable material can be used for holder 10. Plastics are preferred, such as vinyl that is from 120 to 500 microns thick.

Another dimension of some importance is dimension d, FIG. 1. This should be at least about 1.25 cm to insure holder 10 can be properly positioned in the printer, and still print a return address. Dimension d' need only be sufficient to hold the leading edge of the envelope in pocket 16, for example, about 6 mm.

Figure 3:
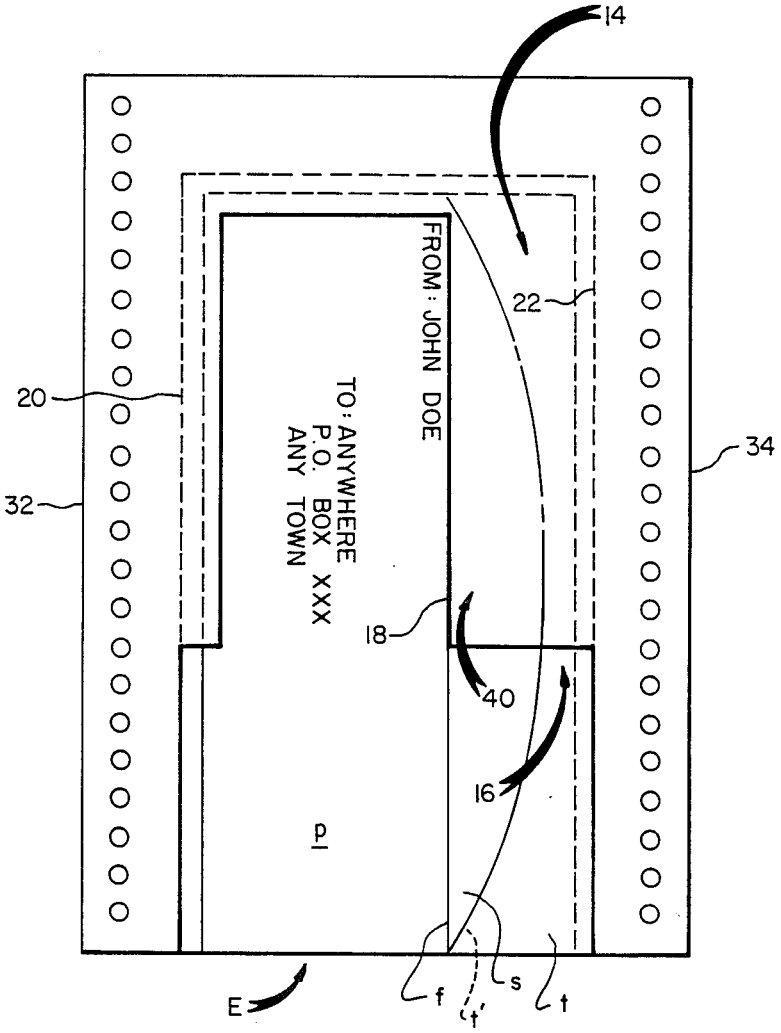
FIG. 3 is a plan view similar to that of FIG. 1, but illustrating the use of the holder with an envelope in place.

FIG. 3 illustrates a preferred use. Envelope "E" is inserted into pocket 16, with the multiple-ply pocket portion "p" lined up with window 18 to allow the printing of addresses. Sealing flap "s" attached to pocket "p" at fold line "f" extends under the portion 40 of upper sheet 14 that covers about one-half of the envelope. As shown, envelope E preferably has a standard envelope shape. Alternatively, however, flap "s" can be connected along a tear line t' to a tear-off portion "t" removable along the tear-line "t'", to give the envelope a rectangular shape. Upper sheet 14 and edge 20 are useful in preventing skewing of the envelope. Window 18 extends parallel to the direction of longitudinal edges 33 and 34, because printers conventionally support either rotatable fonts or graphic modes that allow printing in a direction 90° to the so-called "normal" printing direction that extends transversely to edges 32 and 34.

Figure 4:
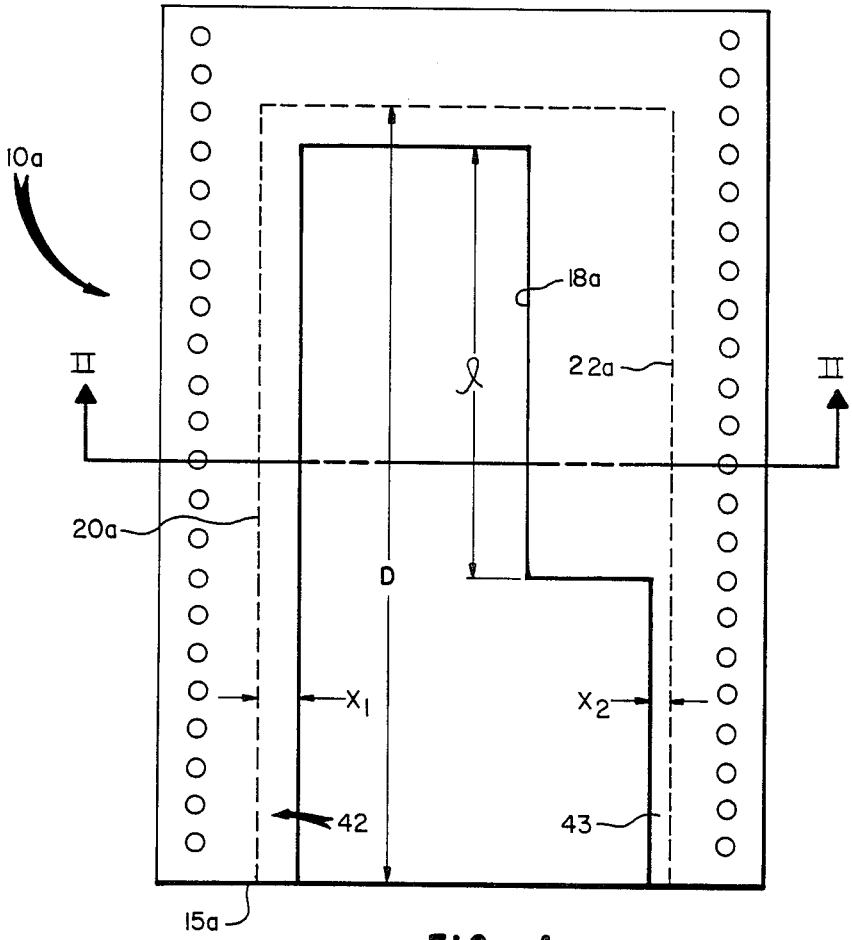
FIG. 4 is a plan view similar to that of FIG. 1, but illustrating an alternate embodiment.

It is not essential that both edges 20 and 22 terminate with a length equal to depth 1. As shown in FIG. 4, edge **20*a* can have a length corresponding to length D, or any length between 1 and D. Parts similar to those previously described bear the same reference numeral, to which the distinguishing suffix "a" has been added. Thus, holder 10*a* is identical to that previously described, except that edge 10*a* has a length D rather than length 1 that is used in the previous embodiment. Because window 18*a* is adjacent edge 20*a* rather than edge 22*a*, the extra material resulting at portion 42 is insufficient to create the bnding that occurs if edge 22*a* extended to trailing transverse edge 15*a*. In addition, the minor amount of "extra" material 43 provided at edge 22*a*, FIG. 4**, is acceptable, so long as dimensions $X_1$ and $X_2$ are less than about 2.5 cm each. Most preferably, however, $X_1$ and $X_2$ each equal zero.

Figure 5:
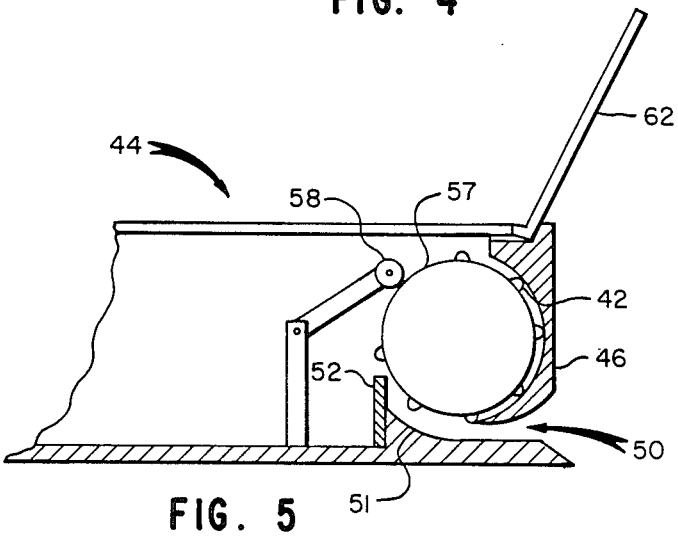
FIG. 5 is a fragmentary elevational view in section of an ink jet printer with which the invention is useful.

FIG. 5 is illustrative of one type of printer 44 with which the invention is preferably used. The envelope holder (not shown) is fed into the back 46 of the printer at an ingress aperture 50. An arcuate guide surface 51 directs the holder into position for engagement with drum platen 57 and the sprocket teeth 42 that are conventionally mounted on such platens. A vertical, flexible shim member 52 forces the holder upwardly in further close proximity to platen 57, and in proper position past the print head, not shown. Bail 58 keeps out of the way the portion of the envelope holder that is already printed and has passed the print head, and directs such portion out of the top of the printer. (The lid 62 preferably remains raised for the printing of the envelopes.)

It is the narrow passage between surface 51, shim member 52, and platen 57 that creates the build-up that tends to cause envelopes in the holder to bind and prevent proper advancement of the holder, if the holder is not constructed as described above.

EXAMPLES

The following examples demonstrate the importance of selectingn a depth 1 for at least edge 22 of holder 10, FIG. 1, that is between about 30% and about 85% of length D. (D here was abou 24 cm.) The holder was constructed as shown in FIGS. 1 and 2, wherein the material was a plasttic, specifically vinyl, and had a cross-sectional thickness "T", FIG. 2, of about 500 microns.

EXAMPLES 1–25

In each of the following examples, 10 envelopes were separately fed in the holder through a Diconix 150 TM Ink Jet Printer generally constructed as shown in FIG. 5. Five different printers were tried to avoid printer idiosyncrasies. The envelopes had the configuration shown in FIG. 3 and were **24 1*b*** white wove paper bond. Results appear in Table I. An envelope failed if it either skewed, or jammed in the printer (could not be fed) (Examples 1, 3–8, 10, 14–15).

TABLE I

| EX | PRINTER NUMBER | AMOUNT OF EDGE SUPPORT (OF D) | # PASSED | # FAILED | % FAILURE |
|---|---|---|---|---|---|
| 1 | 1 | 100% | 7 | 3 | 30% |
| 2 | 2 | " | 10 | 0 | 0% |
| 3 | 3 | " | 3 | 7 | 70% |
| 4 | 4 | " | 8 | 2 | 20% |
| 5 | 5 | " | 7 | 3 | 30% |
| 6 | 1 | 94.7% | 9 | 1 | 10% |
| 7 | 2 | " | 9 | 1 | 10% |
| 8 | 3 | " | 9 | 1 | 10% |
| 9 | 4 | " | 10 | 0 | 0% |
| 10 | 5 | " | 8 | 2 | 20% |
| 11 | 1 | 89.5% | 10 | 0 | 0% |
| 12 | 2 | " | 10 | 0 | 0% |
| 13 | 3 | " | 10 | 0 | 0% |

TABLE I-continued

| EX | PRINTER NUMBER | AMOUNT OF EDGE SUPPORT (OF D) | # PASSED | # FAILED | % FAILURE |
|---|---|---|---|---|---|
| 14 | 4 | " | 8 | 2 | 20% |
| 15 | 5 | " | 9 | 1 | 10% |
| 16 | 1 | 84.2% | 10 | 0 | 0% |
| 17 | 2 | " | 10 | 0 | 0% |
| 18 | 3 | " | 10 | 0 | 0% |
| 19 | 4 | " | 10 | 0 | 0% |
| 20 | 5 | " | 10 | 0 | 0% |
| 21 | 1 | 68.5% | 10 | 0 | 0% |
| 22 | 2 | " | 10 | 0 | 0% |
| 23 | 3 | " | 10 | 0 | 0% |
| 24 | 4 | " | 10 | 0 | 0% |
| 25 | 5 | " | 10 | 0 | 0% |

These tests demonstrated that about 85% of the total length of the lower sheet was the maximum tolerable length of the longitudinal edges of the upper sheet, since lengths greater than that produced jamming in some instances, that is, in more than one printer.

EXAMPLES 26 and 27

In this experiment, envelopes in each example were fed through printer no. 3 to see how little depth "1" would be needed to prevent skewing. The envelopes were 16 lb white wove paper bond. The results appear in Table II.

TABLE II

| EX | AMOUNT OF EDGE SUPPORT | # PASSED | # FAILED | % FAILURE |
|---|---|---|---|---|
| 26 | 36.8% | 10 | 0 | 0% |
| 27 | 10.5% | 6 | 4 | 40% |

From this it was concluded that 30% was the lower limit beyond which skewing occurs, as shown in Example 27.

In addition, examples 26–27 were repeated on 28 lb envelopes, but these were found to jam, indicating that the weight of the envelope was unsuitable.

The invention has been described in detail with particular reference to preferred embodiments thereof, but it will be understood that variations and modifications can be effected within the spirit and scope of the invention.

What is claimed is:

1. In an envelope holder for holding and positioning an envelope for printing on a printer, said holder comprising a pocket defined by an uppe sheet and a lower sheet joined to said upper sheet at selected places, said sheets having respective longitudinal edges, said uppe sheet having a portion cut away to expose a portion of an envelope held in the holder, said selected joining places including at least longitudinal portions of said lower sheet adjacent to said longitudinal edges of said lower sheet, and at least a transverse portion adjacent to an edge of said lower sheet extending transversely between said lower sheet longitudinal edges, at least one of said upper sheet longitudinal edges extending only a fraction of the length of said lower sheet from said transverse joined portion;

the improvement wherein said fraction is sufficiently large as to provide side support of envelopes that prevents skewing of an envelope that is passed through the printer in said holder, and sufficiently small as to prevent a held envelope and said holder from jamming in a printer, and wherein said pocket along one of said longitudinal edges of said upper sheet extends out over a envelope held in said pocket by about one-half the width of the envelope.

2. In an envelope holder for holding and positioning an envelope for printing on a printer, said holder comprising a pocket defined by an upper sheet and a lower sheet joined t said upper sheet at selected places, said sheets having respective longitudinal edges, said upper sheet having a portion cut away to expose a portion of an envelope held in the holder, said selected joining places including at least longitudinal portions of said lower sheet adjacent to said longitudinal edges of said lower sheet, and at least a transverse portion adjacent to an edge of said lower sheet extending transversely between said lower sheet longitudinal edges;

the improvement wherein at least one of said longitudinal edges of said upper sheet opposite to said longitudinal joined portions of said lower sheet extends longitudinally from said transverse joined portion of said lower sheet a distance that is between about 30% and about 85% of the length of said lower sheet from said transverse joined portion, whereby envelopes are held by the holder against skewing without jamming the printer.

3. A holder as defined in claim 2, wherein said pocket along one of said longitudinal edges of said uppe sheet extends out over an envelope held in said pocket by about one-half the width of the envelope.

4. A holder as defined in claim 2, and further including a line of sprocket holes adjacent each of said longitudinal edges of said lower sheet.

5. A holder as defined in claim 2, wherein said cutaway portion extends in a direction generally parallel to said direction of said line of sprocket holes.

* * * * *

UNITED STATES PATENT AND TRADEMARK OFFICE

CERTIFICATE OF CORRECTION

PATENT NO. : 4,869,485

DATED : September 26, 1989

INVENTOR(S) : Bruce W. Enix

It is certified that error appears in the above-identified patent and that said Letters Patent is hereby corrected as shown below:

Column 5, line 51 should read: --sheets having respective longitudinal edges, said upper--.

Column 6, line 21 should read: --nal edges of said upper sheet extends out over an--.

Column 6, line 27 should read: --sheet joined to said upper sheet at selected places, said--.

Column 6, line 54 should read: --along one of said longitudinal edges of said upper sheet--.

Signed and Sealed this

Fourth Day of September, 1990

*Attest:*

HARRY F. MANBECK, JR.

*Attesting Officer*

*Commissioner of Patents and Trademarks*